United States Patent [19]

O'Connor

[11] Patent Number: 4,801,081

[45] Date of Patent: Jan. 31, 1989

[54] RECEPTACLE FOR STORING ARTICLES SUCH AS NEWSPAPERS

[75] Inventor: James C. O'Connor, Tonawanda, N.Y.

[73] Assignee: Joseph P. Armenia, Tonawanda, N.Y. ; a part interest

[21] Appl. No.: 173,877

[22] Filed: Mar. 28, 1988

[51] Int. Cl.[4] ..... B65D 91/00

[52] U.S. Cl. ..... 232/1 C; 248/101; 108/61; 211/57.2; 211/DIG. 1

[58] Field of Search ..... 232/1 C, 1 R, 1 E; 383/43, 49, 75; 248/95, 99, 101

[56] References Cited

U.S. PATENT DOCUMENTS

| | | | |
|---|---|---|---|
| 511,156 | 12/1893 | Newton . | |
| 2,665,842 | 1/1954 | Weintraub et al. | 232/1 |
| 2,671,486 | 3/1954 | Shaw | 383/43 X |
| 2,731,054 | 1/1956 | Driben | 383/43 |
| 2,894,708 | 7/1959 | Kaplan | 248/99 |
| 3,029,853 | 4/1962 | Piazze | 383/75 |
| 3,168,209 | 2/1965 | Brookins et al. | 383/43 X |
| 3,632,029 | 1/1972 | Sonner | 248/95 X |
| 3,802,620 | 4/1974 | Ferrara | 232/19 |
| 3,901,433 | 8/1975 | Jacobs et al. | 232/1 |
| 3,912,208 | 10/1975 | Grenetier | 248/101 X |
| 4,069,994 | 1/1978 | Wharmby | 248/101 |
| 4,694,503 | 9/1987 | Hydorn | 383/12 |

*Primary Examiner*—Robert W. Gibson, Jr.

*Attorney, Agent, or Firm*—Bean, Kauffman & Bean

[57] ABSTRACT

An open mouth receptacle adapted for mounting on a vertically disposed surface, such as a door or wall, is provided for receipt of articles, such as newspapers and packages, delivered to a residence. The receptacle is fabricated from flexible material and has its mouth bounded by facing strips of a relatively rigid and elastic material; the rigid strip assisting in the mounting of the receptacle and the elastic strip tending to normally retain the mouth of the receptacle in a closed condition.

3 Claims, 1 Drawing Sheet

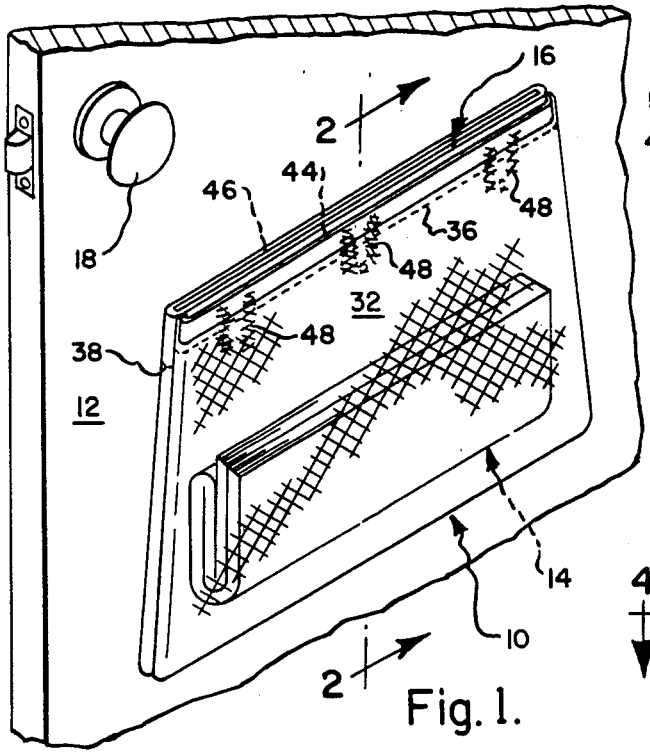
Fig. 1.
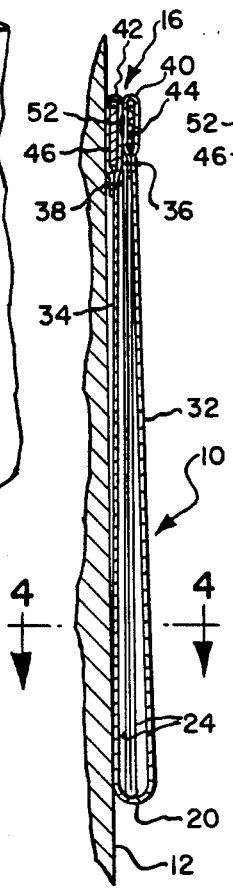
Fig. 2.
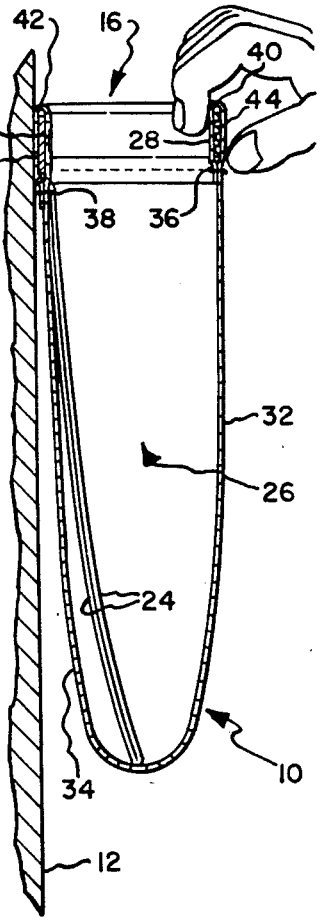
Fig. 3.
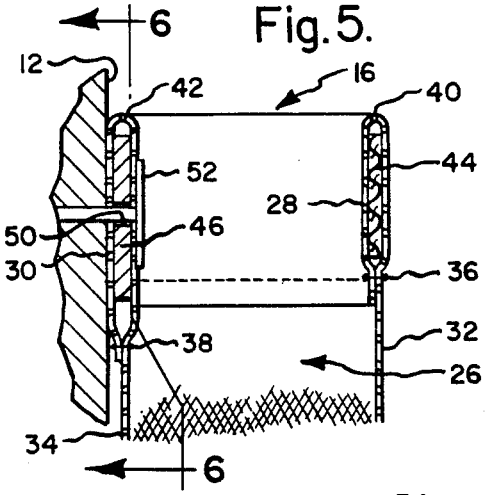
Fig. 5.
Fig. 4.
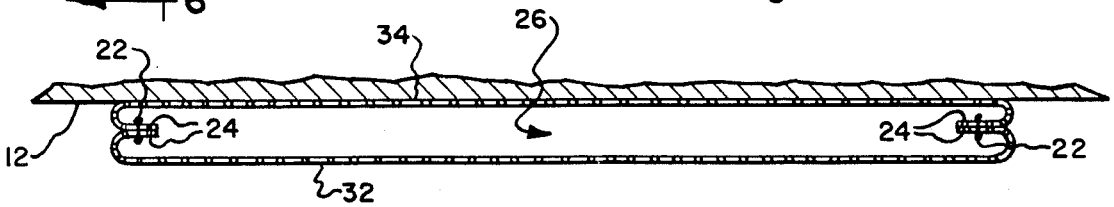
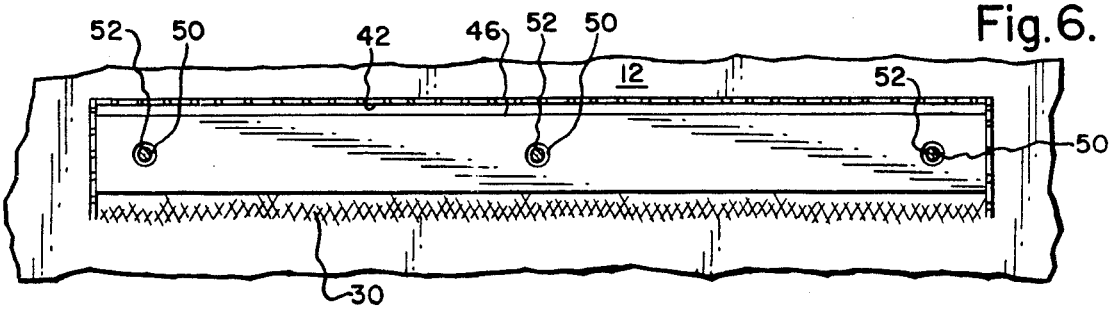
Fig. 6.

RECEPTACLE FOR STORING ARTICLES SUCH AS NEWSPAPERS

BACKGROUND OF THE INVENTION

In rural areas, it has been common practice to provide post mounted cylindrical tubes at the edges of roadways for receipt of newspapers delivered by a newspaper carrier. However, in urban and suburban areas, it is not common practice to provide receptacles for newspapers and as a result newspaper carriers typically leave newspapers on front porches or steps or between a screen/storm door and a front door of each residence.

Placement of newspapers between a screen/storm and front doors is most desirable in that it serves to prevent newspapers from being blown away and offers some protection from the elements. However, there are several drawbacks to this procedure including the time required by the newspaper carrier to open and then firmly close each screen door on an assigned route and the inability to use this delivery procedure in a uniform manner due to the tendency of many customers to keep their screen/storm doors in a locked condition. Also, even where this delivery procedure is possible, it may be objected to by some customers since they are required to bend or stoop in order to pick up their newspapers.

SUMMARY OF THE INVENTION

The present invention is primarily directed to a receptacle intended to facilitate the delivery of newspapers to the door of urban and suburban residences or the like.

The receptacle of the present invention is fabricated from a flexible material and shaped to define a storage chamber sized to freely accommodate a newspaper and an open mouth sized to permit removable insertion of a newspaper into the storage chamber. The mouth is bounded by facing strips of relatively rigid and elastic materials. The rigid strip is preferably formed with mounting aperture sized to receive screw fasteners or nails by which the receptacle may be affixed for instance to a door, porch post or swelling wall for purposes of arranging the mouth of the receptacle at a height convenient for removable insertion of a newspaper thereinto. The elastic strip serves to normally maintain the mouth of the receptacle in closed condition.

BRIEF DESCRIPTION OF THE DRAWINGS

The nature and mode of operation of the present invention will now be more fully described in the following detailed description taken with the accompanying drawings wherein:

FIG. 1 is a perspective view showing the receptacle of the present invention mounted on a door;

FIG. 2 is a sectional view taken generally along the line 2—2 in FIG. 1;

FIG. 3 is a view similar to FIG. 1, but showing the mouth of the receptacle in open condition;

FIG. 4 is a sectional view taken generally along the line 4—4 in FIG. 2;

FIG. 5 is an enlarged view of the upper end of the receptacle, as viewed in FIG. 3; and FIG. 6 is a sectional view taken generally along the line 6—6 in FIG. 5.

DETAILED DESCRIPTION

Reference is first made to FIG. 1, wherein a receptacle formed in accordance with a preferred form of the present invention is generally designated as 10 and shown as being mounted on an exterior surface of a door 12 of a residence at a height convenient to permit removable insertion of a newspaper 14 into the receptacle through an upwardly openings receptacle mouth 16 when the latter is temporarily enlarged in the manner depicted in FIG. 3. The exact height at which receptacle 10 is mounted is a matter of choice, but preferably it would correspond essentially to the height of door knob 18, so as to permit removable insertion of newspaper 14 without excessive bending, while at the same time permitting the interior of the receptacle to be viewed by the newspaper carrier and/or the party to whom newspapers are to be delivered.

In the illustrated form of the invention, receptacle 10 is formed from a loosely woven or open mesh fabric of weather resistant plastic material, such as Nylon, which permits the contents of the receptacle to be viewed without opening mouth 16. However, it is anticipated that receptacle 10 may be formed of any other desired non-rigid or pliable/flexible sheet material, such as for instance canvas or a suitable moisture-proof, plastic sheet material, which may be opaque or transparent, as desired.

More specifically, receptacle 10 is shown as being fabricated by folding a generally rectangular sheet of material in half to define a fold line 20 defining the bottom of the receptacle and then stitching together, as shown at 22 in FIG. 4, the facing in-turned side edge portions 24 of the rectangular sheet to define opposite vertically extending sides of the receptacle and thus bound an inner storage chamber 26, which is sized to freely receive newspaper 14 and disposed in communication with receptacle mouth 16. Assembly of receptacle 10 is completed by folding the front and rear or upper end edge portions 28 and 30, and then stitching same to front and rear panels or surfaces 32 and 34 of the receptacle, as shown at 36 and 38, to define sleeves 40 and 42, which bound the front and rear side edges of mouth 16 and are sized to receive relatively thin, generally rectangular or strip shaped front and rear inserts 44 and 46.

Front insert 44 is in the form of as suitable woven elastic fabric or strip of elastomeric material, such as rubber, having its opposite ends suitably secured or fixed to the opposite ends of sleeve 40, as by stitching 22, while being otherwise free to move or slide within such sleeve as an incident to stretching of the front insert incident to the opening of receptacle mouth 16 as shown in FIGS. 3 and 6. Upon release of front insert 44, it tends to contract or return to its normal non-stretched condition for purposes of maintaining receptacle mouth 16 in its closed condition shown in FIGS. 1 and 2. Expansion and contraction of front insert 44 within sleeve 40 is permitted by providing tucks or loosely gathered areas 48 in the sleeve and front panel 32, as shown in FIG. 1.

Rear insert 46 is formed from a relatively rigid material, such as a wood or plastic slat, which is best shown in FIG. 6 as being sized to extend between the opposite closed ends of sleeve 42 and formed with a plurality of through bore openings 50 adapted to freely receive nails or other suitable headed fasteners 52 adapted to secure receptacle 10 to door 12. Moreover, rear insert 46 serves to maintain sleeve 42 and rear panel 34 in an extended condition, such that a fixed distance is maintain between the opposite ends of elastic front insert 44. As a result, the front and rear side edges of receptacle mouth 16 are maintained essentially straight and in close proximity to one another when the receptacle mouth is in its closed condition shown in FIGS. 1 and 2.

In use, receptacle 10 is first attached to door 12 or other convenient vertically disposed mounting surface adjacent the entrance of a residence to which newspaper 14 is to be delivered. Thereafter, a newspaper carrier, when making a delivery, would simply manually open mouth 16 of receptacle 10, as depicted in FIG. 3, sufficiently to permit a newspaper to be deposited within storage chamber 26 and then release the receptacle to permit elastic front insert 44 to return the receptacle mouth to its initial closed position. Newspaper 14 would simply remain in receptacle 10 until such time as it was retrieved by a person at the residence to which it had been delivered.

The side of receptacle 10 is a matter of choice, but a presently preferred size of about twelve inches high and twenty inches wide is adequate to permit removable insertion of newspapers. As will be apparent, the size of the receptacle may be increased by any desired amount, particularly if it were desired to employ the receptacle as a receiver for delivered packages or other articles in addition to newspapers.

While a preferred receptacle construction has been specifically shown and described, it is contemplated that alternative forms are susceptible of use. One such form would be particularly adapted for use in installations where it would not be desirable or practical to mount the receptacle by means of nails or screws. Specifically, it is contemplated that other receptacle mounting means may be employed, as for instance comprising a first strip of a Velcro fastener attached by stitching or adhesive to the rearwardly facing surface of sleeve 42 and a second strip of a Velcro fastener, which normally engages with the first strip and is provided with an adhesive backing suitable for attachment to a door. The adhesive backing would preferably be protected prior to mounting of the receptacle on the door by a peel-away tape.

I claim:

1. A receptacle adapted for mounting on a vertically disposed surface, such as a door, and for removably storing articles, such as a newspaper, delivered to a residence, said receptacle comprising: non-rigid sheet material forming a storage chamber communicating with a mouth of the receptacle through which said articles may be removably inserted into said chamber, said sheet material is a generally rectangular sheet folded in half with its facing side edge portions joined together and its opposite end portions defining opposite side edges of said mouth, said opposite end portions being folded upon themselves to define a pair of sleeves; a relatively rigid strip extending along one of said opposite side edges of said mouth; a strip of elastic material extending along the other of said opposite side edges of said mouth and tending to resiliently retain said mouth in a closed condition wherein said one and said other of said opposite side edges are disposed in close proximity to one another, said strips are disposed one in each of said sleeves; and means for mounting said receptacle on said surface to arrange said mouth to open upwardly with said relatively rigid strip adjacent said surface.

2. A receptacle according to claim 1, wherein said means for mounting said receptacle are fasteners extending through said relatively rigid strip and said sleeve in which it is received.

3. A receptacle according to claim 2, wherein said sheet material is a loosely woven fabric to permit viewing of contents of said storage chamber.

* * * * *

UNITED STATES PATENT AND TRADEMARK OFFICE

CERTIFICATE OF CORRECTION

PATENT NO. : 4,801,081

DATED : January 31, 1989

INVENTOR(S) : James C. O'Connor

It is certified that error appears in the above-identified patent and that said Letters Patent is hereby corrected as shown below:

Col. 1, line 46 - "swelling" should be ---dwelling---.

Col. 1, line 61 - "Fig. 1" should be ---Fig. 2---.

Col. 2, line 9 - "openings" should be ---opening---.

Col. 2, line 47 - "as" should be ---a---.

Col. 3, lines 2-3 - "maintain" should be ---maintained---.

Col. 3, line 21 - "side" should be ---size---.

Signed and Sealed this

Twenty-fifth Day of July, 1989

*Attest:*

*Attesting Officer*

DONALD J. QUIGG

*Commissioner of Patents and Trademarks*